US007669352B2

(12) United States Patent
Stefani

(10) Patent No.: US 7,669,352 B2
(45) Date of Patent: Mar. 2, 2010

(54) INTERCHANGEABLE COMPONENT SHOE SYSTEM

(75) Inventor: Jerry Stefani, 1315 N. Tustin Ave., Orange, CA (US) 92867

(73) Assignee: Jerry Stefani, Orange, CA (US)

( * ) Notice: Subject to any disclaimer, the term of this patent is extended or adjusted under 35 U.S.C. 154(b) by 339 days.

(21) Appl. No.: 11/694,880

(22) Filed: Mar. 30, 2007

(65) Prior Publication Data

US 2008/0235992 A1 Oct. 2, 2008

(51) Int. Cl.
*A43B 3/24* (2006.01)

(52) U.S. Cl. ..... 36/101

(58) Field of Classification Search ..... 36/101, 36/100, 15

See application file for complete search history.

(56) References Cited

U.S. PATENT DOCUMENTS

| | | | | |
|---|---|---|---|---|
| 2,200,080 | A | 5/1940 | Fein | |
| 2,205,091 | A | 6/1940 | Geffner | |
| 2,261,125 | A | 11/1941 | McFeely | |
| 2,302,596 | A | 11/1942 | Bigio | |
| 2,809,449 | A | 10/1957 | Smith | |
| 2,839,845 | A | 6/1958 | Burton, Jr. | |
| 2,934,838 | A | 5/1960 | Ferreira | |
| 3,601,909 | A | 8/1971 | Amendola | |
| 3,972,136 | A | 8/1976 | Epstein | |
| 3,994,080 | A | 11/1976 | Flanagan, Jr. et al. | |
| 4,103,440 | A * | 8/1978 | Lawrence | 36/101 |
| 4,267,650 | A | 5/1981 | Bauer | |
| 4,270,285 | A | 6/1981 | Antonious | |
| 4,275,513 | A | 6/1981 | Antonious | |
| 4,281,466 | A | 8/1981 | Malone | |
| 4,296,559 | A | 10/1981 | Gamm | |
| 4,333,248 | A | 6/1982 | Samuels | |
| 4,372,060 | A | 2/1983 | Adamik | |
| 4,377,042 | A | 3/1983 | Bauer | |
| 4,384,414 | A | 5/1983 | Gamm | |
| 4,577,418 | A | 3/1986 | Nagy | |

(Continued)

FOREIGN PATENT DOCUMENTS

| | | |
|---|---|---|
| DE | 44 12 154 | 10/1995 |

(Continued)

OTHER PUBLICATIONS

Sports Shoes, *Hong Kong Footwear*, vol. 1, 2007, p. 28.

(Continued)

*Primary Examiner*—Ted Kavanaugh
(74) *Attorney, Agent, or Firm*—Knobbe Martens Olson & Bear LLP

(57) ABSTRACT

A shoe system is provided that comprises a removable upper unit and a sole unit that can be interconnected utilizing respective upper and lower connecting means. The sole unit can include a support panel that can extend substantially continuously about a periphery of the sole unit. A lower portion of the support panel can be connected to an interior area of the sole unit and an upper portion can extend generally upwardly from the lower portion and be disposed circumferentially within the interior of a lower connecting means along the sole periphery. The support panel can be so configured so as to provide structural strength to the shoe system when worn to resist transverse force and reduce tactile friction of the user's foot against the upper and lower connecting means.

19 Claims, 3 Drawing Sheets

U.S. PATENT DOCUMENTS

| | | | | |
|---|---|---|---|---|
| 4,584,783 | A | 4/1986 | Dobbin | |
| 4,612,714 | A | 9/1986 | Gamm | |
| 4,630,383 | A | 12/1986 | Gamm | |
| 4,638,579 | A | 1/1987 | Gamm | |
| 4,697,363 | A | 10/1987 | Gamm | |
| 4,726,128 | A | 2/1988 | Lin | |
| 4,745,693 | A * | 5/1988 | Brown | 36/101 |
| 4,907,352 | A | 3/1990 | Ginsberg | |
| 4,958,447 | A | 9/1990 | DuPree | |
| 4,974,344 | A | 12/1990 | Ching | |
| 5,065,531 | A | 11/1991 | Prestridge | |
| 5,083,385 | A | 1/1992 | Halford | |
| 5,109,614 | A | 5/1992 | Curry | |
| 5,144,759 | A | 9/1992 | Mascotte | |
| 5,311,676 | A | 5/1994 | Hughes et al. | |
| 5,317,822 | A | 6/1994 | Johnson | |
| 5,406,722 | A | 4/1995 | Jones | |
| 5,505,011 | A | 4/1996 | Bleimhofer | |
| 5,544,430 | A | 8/1996 | Jacko | |
| 5,551,172 | A | 9/1996 | Yu | |
| 5,566,477 | A | 10/1996 | Mathis et al. | |
| 5,600,901 | A | 2/1997 | Leonor | |
| 5,642,573 | A | 7/1997 | Brown | |
| 5,727,334 | A | 3/1998 | Cougar | |
| 5,740,559 | A | 4/1998 | Thiel | |
| 5,778,564 | A | 7/1998 | Kettner | |
| 5,921,008 | A | 7/1999 | Ruff | |
| 5,983,528 | A | 11/1999 | Hartung | |
| 6,212,797 | B1 | 4/2001 | Merry et al. | |
| 6,477,788 | B1 | 11/2002 | Chen | |
| D492,474 | S | 7/2004 | Branstrom | |
| 7,013,587 | B2 * | 3/2006 | Yama | 36/101 |
| 2002/0029494 | A1 | 3/2002 | Small | |
| 2002/0066208 | A1 | 6/2002 | Hall | |
| 2002/0088144 | A1 | 7/2002 | Katz et al. | |
| 2002/0184795 | A1 | 12/2002 | Kan | |
| 2002/0194750 | A1 | 12/2002 | Feick | |
| 2003/0088996 | A1 | 5/2003 | Hall | |
| 2003/0177664 | A1 | 9/2003 | Monassebian | |
| 2004/0093764 | A1 | 5/2004 | Cheng | |
| 2004/0128862 | A1 | 7/2004 | Flack | |
| 2004/0143998 | A1 | 7/2004 | Yang | |
| 2004/0187346 | A1 | 9/2004 | Bianchi et al. | |
| 2004/0194349 | A1 | 10/2004 | Delgatty | |
| 2004/0231197 | A1 | 11/2004 | Yama | |
| 2005/0016026 | A1 | 1/2005 | Long | |
| 2005/0034332 | A1 | 2/2005 | Moschel et al. | |
| 2008/0086914 | A1 | 4/2008 | Curry | |

FOREIGN PATENT DOCUMENTS

| | | |
|---|---|---|
| FR | 2659837 | 9/1991 |
| GB | 874 066 | 8/1961 |
| WO | WO 03/000082 | 1/2003 |
| WO | WO 03/075696 | 9/2003 |

OTHER PUBLICATIONS

International Search Report and Written Opinion received in co-pending PCT Application No. PCT/US2008/056283, mailed Jul. 3, 2008, 10 pages.

"NapForm™ Zip-Around™ Slippers". *Brookstone®—Innovations for Home and Life*. May 10, 2007. www.brookstone.com/store/product.asp?product_code=557058&search_type=search&search.

* cited by examiner

INTERCHANGEABLE COMPONENT SHOE SYSTEM

BACKGROUND

1. Field of the Inventions

The present inventions relate generally to footwear and more particularly, to a unique interchangeable component shoe system having a removable upper unit and a sole unit that are adapted to be securely, yet removably, attached to each other and to provide enhanced lateral stability, structural strength, and durability.

2. Description of the Related Art

Interchangeable shoe structures that use separate uppers and soles have repeatedly appeared in the art of shoemaking. Typically, these shoe structures include a zipper for other comparable mechanism that allows the uppers to be securely fastened to the soles. Additionally, many of these shoe structures allow a user to interchange various types of uppers with a given sole and vice-versa, in order to allow the user to replace a worn out sole or to interchange the upper or sole for aesthetic purposes.

Interchangeable shoes are desirable because they allow the user to customize their shoes according to any variety of designs and shapes. The user can distinguish their own athletic shoe from other athletic shoes based on a specific feature or design element that may be particularly desirable. The user can incorporate various other features, such as a different type of sole for a specific purpose. For example, the sole of a running shoe can be molded from various types of materials, designed for a specific type of foot or foot action (such as pronation or supination), or designed for a specific application (such as a racing flat, a trail running shoe, or a cross training shoe). In like manner, the user can select and use a particular upper for the athletic shoe that incorporates various functional features and design elements as desired.

An interchangeable shoe is also beneficial because it is common that the sole of a shoe wears out before the upper. Typically, the sole becomes worn out if the tread on the sole wears down or if the shoe is used for a particular period of time or over a particular distance. With standard athletic shoes, although the sole may be the only expired portion of the shoe, the entire shoe must discarded. The soles of some shoes, such as those with leather uppers, can commonly be replaced when they are worn out. However, interchangeable shoes can allow the user to make use of and better care for their shoes, whether the shoes are for dress, casual, or athletic purposes.

Various attempts have been made to create an interchangeable shoe structure that allows an individual to replace the sole of the shoe when it becomes worn out, or additionally, to interchange the sole or upper of the shoe as desired for aesthetic purposes. However, a successful interchangeable shoe structure has yet to be incorporated into the shoe market. While there are various reasons why such an interchangeable shoe structure has not been successful in the marketplace, one of the certain limitations of interchangeable shoe structures is the ability to provide appropriate structural strength, lateral support, and durability in use, such as during athletic activities.

Therefore, there is a need in the art for an interchangeable shoe system that provides a user with the ability to quickly and easily modify the appearance and/or structure of the shoe system. Further, there is a need in the art for an interchangeable shoe system that provides exceptional lateral support, structural strength, and durability for a user's foot while the user is participating in athletic activities that require rigorous and sudden movements in directions such as forward, reverse, side-to-side, and pivoting. Further, there is a need in the art for an interchangeable shoe system that allows a user to selectively modify the aesthetic qualities of the shoe. Finally, there is a need in the art for an interchangeable shoe system that allows a user to securely fasten an upper to a sole such that the upper does not disengage from the sole during casual or athletic use.

SUMMARY OF THE INVENTIONS

In accordance with an embodiment, a shoe system is provided that comprises a removable upper unit and a sole unit. The removable upper unit can have a lower edge extending at least partially along a lower periphery of the upper unit. The upper unit can also have an upper connecting means extending generally downwardly from the lower edge of the upper unit, the upper unit being configured to extend across at least a portion of a user's foot. The sole unit can have a sole base and an upper edge extending generally upwardly therefrom. The sole base can define a sole periphery and an interior area. The upper edge can extend at least partially about the sole periphery. The sole unit can have a lower connecting means extending generally upwardly from the upper edge. The lower connecting means can be attachable to the upper connecting means of the upper unit in order to facilitate removable attachment of the upper unit to the sole unit.

The sole unit can further have a support panel extending about at least a portion of the sole periphery. The support panel has a lower portion and an upper portion. The lower portion of the support panel can be attached to the sole base and extend generally inwardly toward the interior area relative to the sole periphery. The lower portion of the support panel can be attached to the sole base. The upper portion of the support panel can extend generally upwardly from the lower portion and be disposed circumferentially within the interior of to the lower connecting means along the sole periphery.

The support panel can be configured the upper portion thereof extending at least partially above the lower connecting means with the support panel generally abutting both the upper connecting means and the lower connecting means upon attachment of the upper connecting means to the lower connecting means when the upper unit is attached to the sole unit. The support panel can be so configured so as to provide structural strength to the shoe system when worn to resist transverse force and reduce tactile friction of the user's foot against the upper and lower connecting means.

The shoe system can further comprise a sole insert that can be sized and configured to be received within the interior area of the sole base. The sole insert can be attached to the lower portion of the support panel and to a top surface of the sole base for fixing the orientation of the support panel with respect to the sole base.

In accordance with another embodiment, the shoe system can further comprise an insole having an insole periphery and a raised wall extending generally upwardly from the insole at least partially about the insole periphery. The insole can be sized and configured to be fitted into the interior area of the sole base with the raised wall abutting at least a portion of an interior face of the support panel for supplementing the structural strength of the support panel against transverse force. Furthermore, the raised wall of the insole can comprise an upper lip that can be sized and configured to extend at least partially above the upper portion of the support panel along at least a heel section of the raised wall for reinforcing the support panel therealong against transverse force and to reduce tactile friction of the user's foot against the upper and lower connecting means.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

As will be described in further detail below, embodiments of the present inventions provide a unique and distinctive shoe system that can be quickly and easily modified according to a user's preferences and needs. The shoe system allows a user to disassemble shoe into two or more constituent parts and to interchange any of those parts with other such parts that may be of different configurations, colors, or materials. For example, the user may interchange an athletic shoe upper with a casual shoe upper of a different color.

However, one of the many advantages associated with embodiments disclosed herein is that the sole of the shoe system incorporates a unique design that provides substantial lateral stability at the intersection of the removable upper and the sole of the shoe. In particular, the sole can incorporate at least one support structure positioned adjacent the intersection of the upper and the sole that can be firmly attached to the sole unit. The support structure can function to not only enhance the lateral stability of the shoe, but also to aid in maintaining the integrity of the interconnection of the sole and upper and to separate this interconnection from contact with the user's foot. As a result, embodiments of the shoe system can provide the look and feel of a normal athletic shoe while enabling the user to modify the configuration and appearance of the shoe system as desired.

Figure 1:
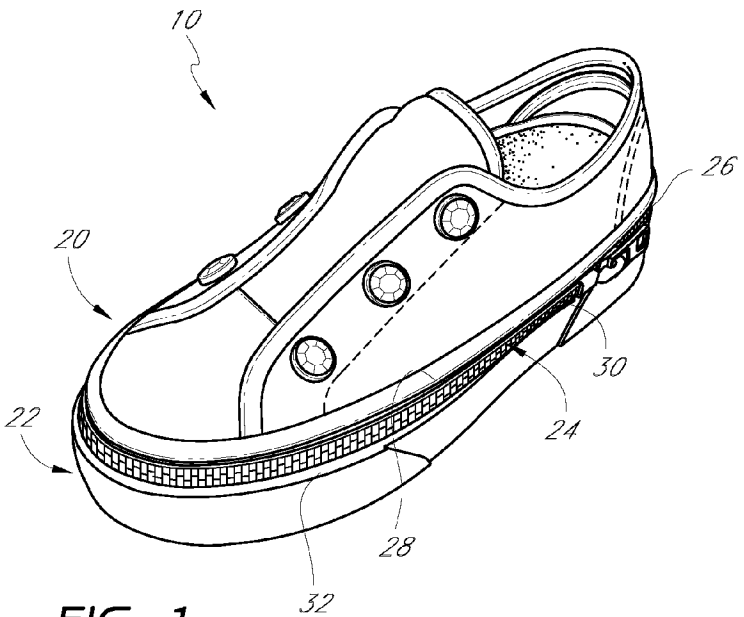
FIG. 1 is a perspective view of a shoe system including a removable upper unit and a sole unit, according to an embodiment.

Referring now to the drawings wherein the showings are made for purposes of illustrating preferred embodiments of the present inventions, and not for purposes of limiting the same, FIG. 1 is a perspective view of a shoe system 10 comprising a removable upper unit 20 and a sole unit 22. The shoe system 10 is illustrated in FIGS. 1-6 as an athletic shoe that covers substantially all of the user's foot, including the forefoot, toes, and heel portion of the foot just below the ankle. However, it is contemplated that the shoe system can be modified to incorporate myriad types of shoe designs and configurations. Therefore, although the figures illustrate exemplary embodiments of the removable upper unit 20 and the sole unit 22, these elements of the shoe system 10 can be variously modified to provide the user with a myriad of options for personalizing the shoe system 10 as desired.

The upper unit 20 can be configured to extend across at least a portion of the user's foot. For example, the upper unit 20 can be configured to expose more or less of the foot, as desired. Such embodiments can encompass a wide range of footwear uppers from sandals to high-top sneakers and boots. The upper unit 20 can be fabricated from a variety of materials as known in the art, such as cloth, plastics, composites, leather, fabrics, etc.

The sole unit 22 illustrated in FIGS. 1-6 can also be variously configured such that the shoe system 10 can be adapted for use as a performance athletic shoe, a casual shoe, a heeled shoe, just to name a few. The sole unit 22 can likewise incorporate various types of tread patterns and can be fabricated from any desired material and can also be formed to provide a desired appearance and color. The sole unit 22 can also be fabricated from a variety of materials as known in the art.

As illustrated in FIG. 1, the upper unit 20 can be interconnected to the sole unit 22 by the use of a connecting means 24. The connecting means 24 can tend to ensure that the upper unit 20 is securely attachable to the sole unit 22 so that during use, the upper unit 20 seems to be integrally formed with the sole unit 22 and not separately formed. The connecting means 24 can be used to securely attach respective portions of the upper unit 20 to the sole unit 22. In accordance with a preferred embodiment, the connecting means 24 can include a zipper that incorporates parallel rows of interlocking teeth and a sliding tab. Various types of zippers are available in different styles, colors, sizes, and technical specifications. Although the connecting means 24 can include a zipper, the connecting means 24 can also include other materials that allow the upper unit 20 to be attached to the sole unit 22, such as Velcro, buttons, laces, clips, hooks, straps, clamps, and other types of fasteners.

Further, it is contemplated that such fasteners can also be used to ensure that the sole unit 22 is securely held on the user's foot. In other words, the upper of a shoe typically ensures that the entire shoe is securely held on the user's foot. In contrast, some embodiments disclosed herein can utilize the upper unit 20 as decorative and the upper unit 20 need not function to maintain the shoe securely held on the user's foot. In such embodiments, the removable upper unit 20 can be fastened to the sole unit 22 using less robust connecting means 24 because the interconnection between the upper unit 20 and the sole unit 22 would not be critical in ensuring that the sole unit receives and distributes the various forces generated during use of the shoe system 10. Thus, such embodiments could utilize other fasteners to ensure that the sole unit 22 is securely held to the user's foot.

Figure 2:
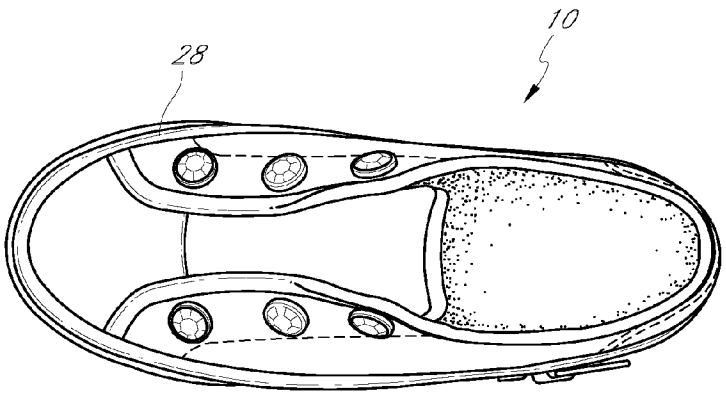
FIG. 2 is a top view of the shoe system shown in FIG. 1.

Referring now to FIGS. 1 and 2, the upper unit 20 can have a lower edge 26 that extends at least partially along a lower periphery 28 of the upper unit 20. As mentioned above, the upper unit 20 is illustratively shown as an upper of an athletic sneaker in the accompanying figures. However, the upper unit 20 can also be configured as a sandal upper, in which case various sections of the user's foot can be exposed. Thus, in such embodiments, the lower edge 26 of the upper unit 20 could be discontinuous along the lower periphery 28 of the upper unit 20.

Similar to the upper unit 20, the sole unit 22 illustrated in FIG. 1 also has an upper edge 30 that extends at least partially about a sole periphery 32. As mentioned above with regard to the lower edge 26, the upper edge 30 can also be continuous or discontinuous along the sole periphery 32. In this regard, it is contemplated that the lower edge 26 can be configured to be positionable adjacent the upper edge 30 when the upper unit 20 is disposed above the sole unit 22. Nevertheless, it is also contemplated that in some embodiments, the upper edge 30 of the sole unit 22 can be continuous about substantially all of the sole periphery 32 in order to be able to matably receive the lower edge 26 of the upper unit 20 regardless of the configuration of the lower edge 26. Thus, a given sole unit 22 could be interchangeable with an upper of a tennis shoe and an upper of a sandal, for example.

Figure 3:
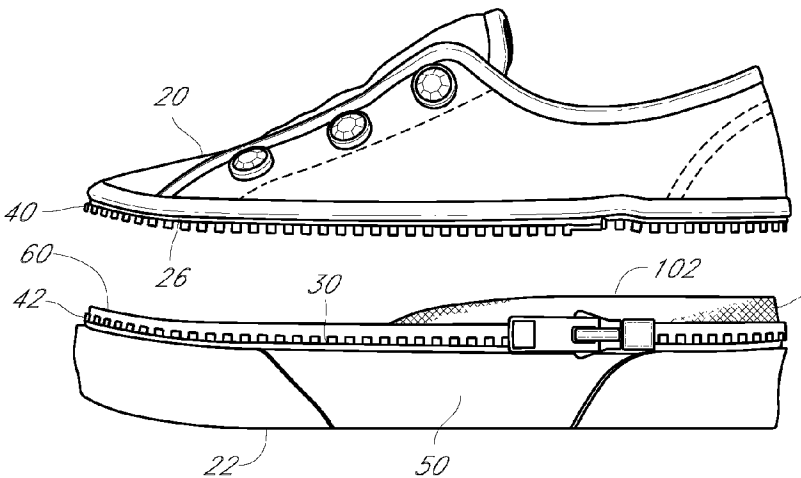
FIG. 3 side view of the shoe system shown in FIG. 1 wherein the removable upper unit is separated from the sole unit.

Referring now to the embodiment illustrated in FIG. 3, the upper unit 20 can be configured to include an upper connecting means 40. Additionally, the sole unit 22 can also be configured to include a lower connecting means 42. The upper connecting means 40 can extend from the lower edge 26 of the upper unit 20 into a position whereat the upper connecting means 40 can interconnect with the lower connecting means 42.

In some embodiments, the upper connecting means 40 can extend generally downwardly from the lower edge 26; however, it is contemplated that the upper connecting means 40 can assume a variety of orientations relative to the lower edge 26 of the upper unit 20. As such, when the upper unit 20 is connected to the sole unit 22, the lower edge 26 can be positioned at least partially above or below the upper edge 30 of the sole unit 22. It is contemplated that various configurations can be produced to position the lower edge 26 above or below the upper edge 30. Furthermore, it is contemplated that various other configurations can be produced such that the lower edge 26 is positioned circumferentially interior to or exterior to the upper edge 30 of the sole unit 22 when the shoe system 10 is assembled.

Referring again to FIG. 3, the sole unit 22 can have a sole base 50. The sole base 50 can be formed to include the tread of the shoe and to define the sole periphery 32 and to further define an interior area 52. As illustrated in FIGS. 3-6, the upper edge 30 can extend from the sole base 50. As shown, the upper edge 30 can extend generally vertically upwardly relative to the sole base 50 in some embodiments. The upper edge 30 can be integrally with or separately formed from the sole base 50. The general vertical extension can include variations of 45 degrees from the vertical. Further, the lower connecting means 42 can extend from the upper edge 30 such that it is attachable to the upper connecting means 40. As similarly described above with respect to the upper connecting means 40, the lower connecting means 42 can extend from the upper edge 30 in a variety of directions and can provide various configurations of the sole unit 22. In some embodiments, the lower connecting means 42 can extend generally upwardly relative to the upper edge 30. Any of the selected configurations preferably facilitate the removable attachment of the upper connecting means 40 to the lower connecting means 42 such that the upper unit 20 is quickly and easily attachable or removable from the sole unit 22.

In accordance with another embodiment, the sole unit 22 can be configured to have a support panel 60. The support panel 60 can extend about at least a portion of the sole periphery 32. In some embodiments, the support panel 60 can extend along the sole periphery 32 about a front end 62 of the sole unit 22. In such embodiments, the support panel 60 can provide additional lateral support for the user's forefoot. Additionally, in other embodiments, the support panel 60 can extend along the sole periphery 32 about a rear end 64 of the sole unit 22. In such embodiments, the support panel 60 would likewise provide additional lateral support about the heel portion of the user's foot. Furthermore, it is contemplated that the support panel 60 can extend along opposing sides 66 of the sole periphery 32 intermediate the front end 62 and the rear end 64 of the sole unit 22.

In preferred embodiments, the support panel 60 can extend substantially continuously about the sole periphery 32. For example, the support panel 60 can be "substantially continuous" about the sole periphery 32 where the support panel 60 is able to directly or indirectly transfer transverse forces from one portion of the support panel 60 to another portion, such as from the front end 62 toward the rear end 64. Additionally, "substantially continuous" extension of the support panel 60 can refer to the peripheral length of the support panel 60, such as extending along 80% or more of the length of the sole periphery 32. In some embodiments, the support panel 60 can preferably be fabricated from at least one continuous piece of material. In this regard, the support panel 60 can be made from a single piece of fabric material. However, the support panel 60 can be coupled to other portions of the sole unit 22 to transfer transverse forces and provide the desired lateral stability. In other embodiments, the support panel 60 can include other reinforcement materials that are positioned adjacent to or attached to the support panel 60. Accordingly, embodiments of the support panel 60 can be fabricated from at least one type of material and optimized according to the user's needs. Further variations and configurations of the support panel 60 are discussed below and will be apparent to one of skill in the art based upon the present disclosure.

Figure 4:
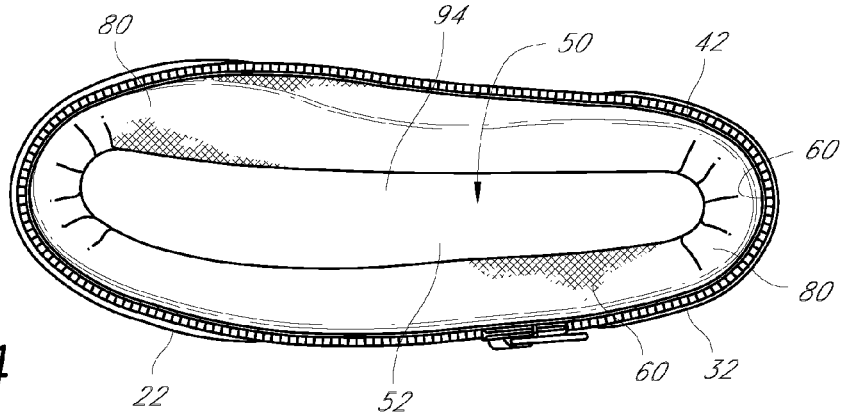
FIG. 4 is a top view of the sole unit, according to another embodiment.
Figure 5:
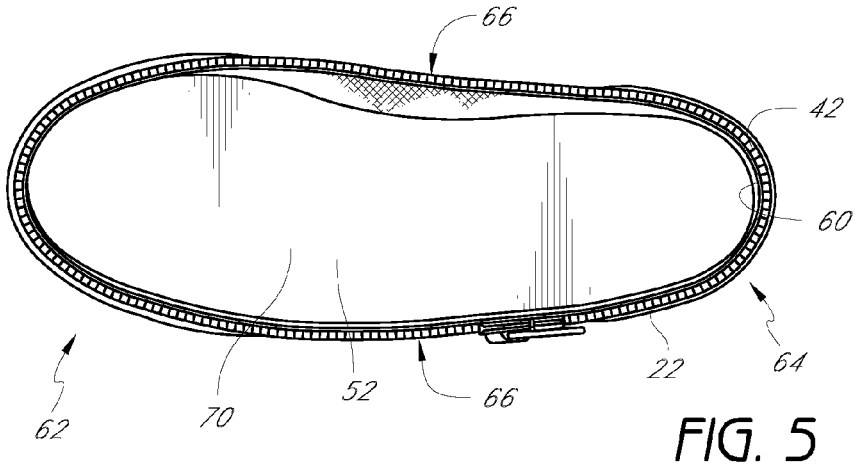
FIG. 5 is a top view of the sole unit wherein a sole insert is received within an interior area of the sole unit, according to another embodiment.
Figure 6:
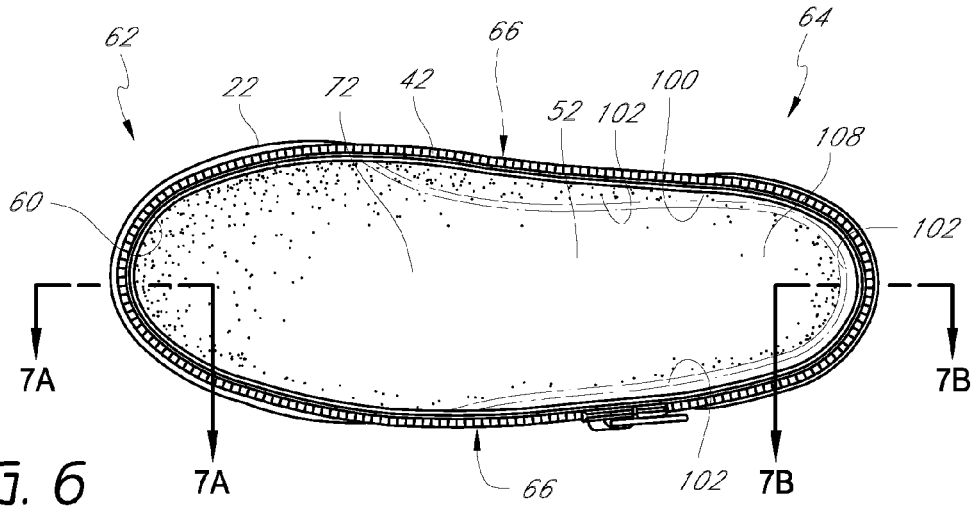
FIG. 6 is a top view of the sole unit wherein an insole is disposed therein, according to yet another embodiment.
Figure 7B:
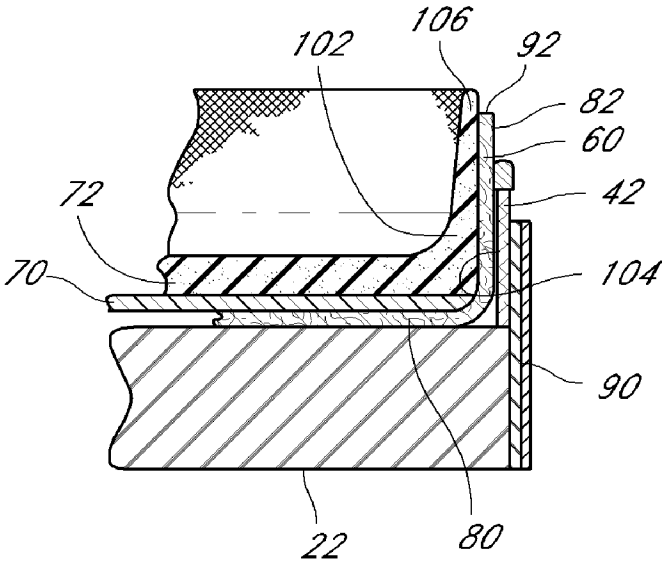
FIG. 7B is a side cross-sectional view of the embodiment illustrated in FIG. 6 taken along lines 7B-7B.
Figure 7A:
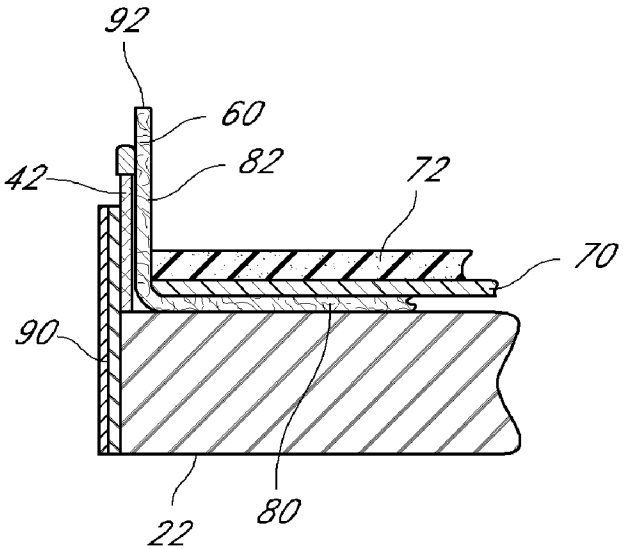
FIG. 7A is a side cross-sectional view of the embodiment illustrated in FIG. 6 taken along the lines 7A-7A.

Referring now to FIGS. 4-6, the various configurations of the sole unit 22 are illustrated. FIG. 4 is a top view of the sole unit 22 illustrating an exemplary support panel 60 that is disposed in the interior area 52 of the sole base 50 and rises vertically about the sole periphery 32. FIG. 5 is a top view of an embodiment of the sole unit 22 wherein a sole insert 70 is disposed within the interior area 52 of the sole base 50. FIG. 6 is a top view of the sole unit 22 shown in FIG. 3, which illustrates that the sole unit 22 can further comprise an insole 72 that can be disposed above and used in combination with the sole insert 70. Finally, FIGS. 7A and 7B illustrate side cross-sectional views of the front end 62 and the rear end 64, respectively, of the sole unit 22 illustrated in FIG. 6. As described further herein, each of these figures serves to illustrate features of embodiments of the shoe system 10 that can be utilized to enhance the structural strength and lateral stability of the shoe system 10. Other advantages and modifications will also be readily apparent.

As shown in FIGS. 4 and 7A-7B, the support panel 60 can be configured to have a lower portion 80 and an upper portion 82. The lower portion 80 can extend generally inwardly from the sole periphery 32 toward a central portion of the interior area 52 of the sole base 50. In this regard, it is contemplated that the lower portion 80 can extend oriented generally horizontally or sloped. For example, in an embodiment described below, where the lower portion 80 is embedded within the sole base 50, the lower portion 80 can slope generally downwardly into and/or within the sole base 50, or can be horizontally disposed on the sole base 50.

The lower portion 80 of the support panel 60 can be securely attached to the sole base 50 using adhesives, fasteners, or other bonding processes. Adhesives such as glue, resin, paste, and other joining agents, to name a few, can be used.

Fasteners such as threads, stitches, etc. can also be used. Finally, other bonding processes can be used to thermally, chemically, or mechanically work the materials to create a strong bond between the materials.

The engagement of the lower portion 80 of the support panel 60 with the sole base 50 can be variously modified to enhance the stability and performance of the shoe system 10. In this regard, preferred embodiments allow forces exerted on various portions of the support panel 60 to be readily transmitted throughout the support panel 60 and to the sole base 50. As such, the support panel 60 can provide lateral support and stability for the user's foot. Thus, in preferred embodiments, the strength of the engagement of the lower portion 80 to the sole base 50 is sufficient to withstand any transverse or shear forces exerted upon the support panel 60 and upon the interconnection of the support panel 60 and the sole base 50. The shoe system 10 can therefore be configured such that the sole base 50 is in collaborative engagement with the support panel 60 to provide effective stabilization and structural strength.

In some embodiments, as illustrated in FIG. 4, the lower portion 80 extends along at least one-fourth of the width of the interior area 52. FIGS. 7A and 7B also illustrate that the lower portion 80 can extend generally inwardly from the sole periphery 32 toward a central portion of the interior area 52 of the sole base 50. Thus, it is contemplated that the lower portion 80 of the support panel 60 can occupy at least a portion of the interior area 52 of the sole base 50. In such embodiments, another material can be utilized to fill the remainder of the interior area 52 so as to provide a level surface above the lower portion 80 of the support panel 60.

However, in other embodiments, the lower portion 80 can also extend along substantially all of the interior area 52, for example, with the lower portion 80 extending from the opposing sides 66 and converging to the central portion of the interior area 52. It is therefore contemplated that modifications to the size and engagement surface of the lower portion 80 can affect the strength of the engagement between the support panel 60 and the sole base 50. Thus, the length/width and spacing of the lower portion 80 can be modified in various embodiments according to the needs and specifications. Furthermore, while the engagement of the lower portion 80 is illustrated as being superficial to the sole base 50, it is contemplated that the lower portion 80 can also be embedded within the sole base 50 in a variety of configurations.

As illustrated in FIGS. 3 and 7A-7B, the upper portion 82 of the support panel 60 can be configured to extend generally upwardly from the lower portion 80 and can be disposed circumferentially within the interior of the connecting means 24 along the sole periphery 32. In some embodiments, at least a portion of the upper portion 82 of the support panel 60 can be securely attached to the lower connecting means 42, and additionally, to a peripheral wall 90 of the sole unit 22.

As mentioned previously, the support panel 60 can be utilized to provide additional lateral support to the user's foot and to further stabilize the sole unit 22 of the shoe system 10. In this regard, the support panel 60 can be fabricated from a variety of useful materials. For example, the support panel 60 can be fabricated from a flexible, resilient material, such as plastic. However, in preferred embodiments, the support panel 60 can be fabricated from a medium weight fabric material. Further, it is contemplated that the support panel 60 can be a composite of multiple materials. Such materials may include inserts that run generally horizontally within the upper portion 82 and/or lower portion 80 of the support panel 60. However, such materials can also run vertically within the upper portion 82 and extend into the lower portion 80 of the support panel 60. Further, it is contemplated that such materials can comprise a mesh that runs throughout the support panel 60 and provides reinforcement thereto. Other composite configurations and materials can be utilized and the design and structure of the support panel 60 can be modified using the teachings herein.

In the embodiment illustrated in FIGS. 3-6, the support panel 60 comprises at least one continuous piece of material that extends substantially continuously about the sole periphery. An advantage of such an embodiment is that forces exerted against the support panel 60 in the front end 62 of the shoe system 10 can be transferred throughout the support panel 60 along the opposing sides 66 and towards the rear end 64 of the sole unit 22 because of the continuity of the support panel 60. As such, the support panel 60 can tend to enhance the strength, durability, and stability of the shoe system 10.

In accordance with the embodiment illustrated in FIGS. 7A-7B, the support panel 60 can be configured to extend at least partially above the lower connecting means 42. For example, the support panel 60 can include a top rim 92 that extends at least partially above the lower connecting means 42. In accordance with another embodiment, the support panel 60 can generally abut both the upper connecting means 40 and the lower connecting means 42 when the upper unit 20 is attached to the sole unit 22. In such embodiments, the support panel 60 can thereby provide stability to the connecting means 24 for resisting transverse forces. Furthermore, the support panel 60 can also be utilized to cover the upper connecting means 40 and the lower connecting means 42. In this manner, the support panel 60 can provide a barrier intermediate the connecting means 24 and the user's foot which can tend to reduce tactile friction of the user's foot against the upper and lower connecting means 40, 42.

Referring again to FIG. 5, the sole insert 70 can be sized and configured to be received within the interior area 52 of the sole base 50. The sole insert 70 can be fabricated, for example, from a durable sheet of material, such as foam, cardboard, or plastic, to name a few. The sole insert 70 preferably has a smooth bottom surface that can substantially engage the lower portion 80 of the support panel 60, as well as any exposed portion of the interior area 52 of the sole base 50. In this regard, according to a preferred embodiment, the sole insert 70 can be attached to at least the lower portion 80 of the support panel 60.

Further, as illustrated in FIG. 4, in the embodiment configured with the lower portion 80 extending approximately one-fourth of the width of the interior area 52, a top surface 94 of the interior area 52 is left exposed. In this embodiment, the sole insert 70 can be attached to the top surface 94 and to the lower portion 80 of the support panel 60. This configuration thereby provides an indirect connection between the support panel 60 and the sole base 50 which can further enhance the engagement between the sole base 50 and the support panel 60. Thus, the sole insert 70 can further secure the relative position of the support panel 60 within the interior area 52 of the sole unit 22. As such, forces exerted on various portions of the support panel 60 can be readily transmitted throughout the support panel 60 and also to the sole base 50. Thus, the shoe system 10 can be configured such that the sole base 50 is in collaborative engagement with the support panel 60 and the sole insert 70 to provide effective stabilization and structural strength.

Referring now to FIG. 6, the shoe system 10 can further comprise the insole 72. The insole 72 can include an insole periphery 100 and a raised wall 102. As illustrated in FIGS. 3 and 7B, the raised wall 102 of the insole 72 can extend generally upwardly from the insole 72 at least partially about the insole periphery 100. In some embodiments, the insole 72 can be sized and configured to be fitted into the interior area 52 of the sole base 50 with the raised wall 102 abutting at least a portion of an inner face 104 of the support panel 60. Thus, the raised wall 102 can be utilized to supplement the structural strength of the support panel 60 against transverse forces.

In accordance with another embodiment illustrated in FIG. 7B, the raised wall 102 of the insole 72 can further comprise an upper lip 106. The upper lip 106 can be sized and configured to extend at least partially above the upper portion 82 of the support panel 60. For example, the upper lip 106 can be sized and configured to extend at least partially above the top rim 92 of the upper portion 82. In some embodiments, the upper lip 106 can extend at least partially above the top rim 92 along at least a heel section 108 of the raised wall 102. In this regard, the raised wall 102 can be positioned throughout the substantially all of the insole periphery 100 or solely along the heel section 108 of the insole 72.

Therefore, the raised wall 102 can be utilized to reinforce the support panel 60 along any desired portion of the sole periphery 32 and to provide additional strength against transverse forces. Further, the raised wall 102 can be used to cover the upper and lower connecting means 40, 42. In this manner, the raised wall 102 can tend to reduce the tactile friction of the user's foot against the upper and lower connecting means 40, 42. Finally, as shown in FIG. 3, the raised wall 102 of the insole 72 can extend toward the front end 62 along the opposing sides 66 of the sole unit 22.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A shoe system comprising:

a removable upper unit having a lower edge extending at least partially along a lower periphery of the upper unit, the upper unit having an upper connecting means extending generally downwardly from the lower edge of the upper unit, the upper unit being configured to extend across at least a portion of a user's foot;

a sole unit having a sole base and an upper edge extending generally upwardly therefrom, the sole base defining a sole periphery and an interior area, the upper edge extending at least partially about the sole periphery, the sole unit having a lower connecting means extending generally upwardly from the upper edge, the lower connecting means being attachable to the upper connecting means of the upper unit in order to facilitate removable attachment of the upper unit to the sole unit, the sole unit further having a support panel extending about at least a portion of the sole periphery, the support panel having a lower portion and an upper portion, the lower portion of the support panel being attached to the sole base and extending generally inwardly toward the interior area relative to the sole periphery, the upper portion of the support panel extending generally upwardly from the lower portion and being disposed circumferentially within the interior of the lower connecting means along the sole periphery, the upper portion of the support panel extending at least partially above the lower connecting means, the sole unit further comprising a sole insert being sized and configured to be received within the interior area of the sole base to at least partially overlap the lower portion of the support panel, the sole insert being attachable to the lower portion of the support panel and to a top surface of the sole base for fixing the orientation of the support panel with respect to the sole base, the support panel being configured so as to provide structural strength to the shoe system when worn to resist transverse force and to reduce tactile friction of the user's foot against the upper and lower connecting means; and an insole having an insole periphery and a raised wall extending generally upwardly from the insole at least partially about the insole periphery, the insole being sized and configured to be fitted into the interior area of the sole base with the raised wall abutting at least a portion of an interior face of the support panel for supplementing the structural strength of the support panel against transverse force.

2. The shoe system of claim 1 wherein the support panel extends along the sole periphery about a front end of the sole unit.

3. The shoe system of claim 2 wherein the support panel extends along the sole periphery about a rear end of the sole unit.

4. The shoe system of claim 3 wherein the support panel extends along opposing sides of the sole periphery intermediate the front and rear ends of the sole unit.

5. The shoe system of claim 1 wherein the support panel extends substantially continuously about the sole periphery.

6. The shoe system of claim 5 wherein the support panel is fabricated from at least one continuous piece of material.

7. The shoe system of claim 1 wherein the sole base is formed separately from the upper edge of the sole unit.

8. The shoe system of claim 1 wherein the lower edge of the upper unit extends continuously along the lower periphery of the upper unit, and the upper connecting means extends generally downwardly from the lower edge of the upper unit continuously about the lower periphery thereof.

9. The shoe system of claim 8 wherein the upper edge of the sole unit extends continuously about the sole periphery, and the lower connecting means extends generally upwardly from the upper edge of the sole unit continuously about the sole periphery thereof.

10. The shoe system of claim 1 wherein the upper and lower connecting means are zippers.

11. The shoe system of claim 1 wherein the raised wall of the insole comprises an upper lip being sized and configured to extend at least partially above the upper portion of the support panel along at least a heel section of the raised wall for reinforcing the support panel therealong against transverse force and to reduce tactile friction of the user's foot against the upper and lower connecting means.

12. The shoe system of claim 11 wherein the raised wall extends about a heel area of the insole.

13. The shoe system of claim 11 wherein the raised wall extends at least partially along opposing sides of the sole periphery intermediate front and rear ends of the sole unit.

14. A shoe system comprising:

an upper unit configured to extend across at least a portion of a user's foot, the upper unit having an upper connecting means extending generally downwardly therefrom;

a sole unit comprising:

a sole base and an upper edge extending generally upwardly therefrom and at least partially about a perimeter of the sole base;

a lower connecting means extending generally upwardly from the upper edge, the lower connecting means being attachable to the upper connecting means of the upper unit in order to facilitate removable attachment of the upper unit to the sole unit;

a support panel extending about at least a portion of the periphery of the sole base, the support panel having a lower portion and an upper portion, the lower portion of the support panel being attached to the sole base and extending generally inwardly from the periphery of the sole base, the upper portion of the support panel extending generally upwardly from the lower portion and being disposed circumferentially within the interior of the lower connecting means along the sole periphery, the upper portion of the support panel extending at least to the height of the lower connecting means, the support panel abutting the lower connecting means to provide structural strength for resisting transverse force against the upper and lower connecting means; and a sole insert being attachable to the lower portion of the support panel and to a top surface of the sole base for fixing the orientation of the support panel with respect to the sole base; and an insole having a raised wall extending generally upwardly from the insole, the insole being configured to be fitted onto the sole unit with the raised wall abutting at least a portion of an interior face of the support panel for supplementing the structural strength of the support panel against transverse force.

15. The shoe system of claim 14, wherein the sole insert at least partially overlaps the lower portion of the support panel.

16. The shoe system of claim 14, wherein the support panel extends along the sole periphery about one of a front end and a rear end of the sole unit.

17. The shoe system of claim 16, wherein the support panel extends substantially continuously about the sole periphery.

18. The shoe system of claim 14, wherein the upper and lower connecting means extend continuously about the sole periphery.

19. The shoe system of claim 14, wherein the upper and lower connecting means are zippers.

* * * * *